US006263626B1

(12) United States Patent
Gerhardt

(10) Patent No.: US 6,263,626 B1
(45) Date of Patent: Jul. 24, 2001

(54) WINDOW AND DOOR SASH WITH INTERIOR WOOD COVERING

(75) Inventor: David C. Gerhardt, New Albany, OH (US)

(73) Assignee: Atria Building Products, Inc., Gahanna, OH (US)

( * ) Notice: Subject to any disclaimer, the term of this patent is extended or adjusted under 35 U.S.C. 154(b) by 0 days.

(21) Appl. No.: 09/497,241

(22) Filed: Feb. 3, 2000

(51) Int. Cl.[7] ..... E06B 3/00
(52) U.S. Cl. ..... 52/204.5; 52/204.62
(58) Field of Search ..... 52/204.53, 204.54, 52/211, 212, 204.69, 204.7

(56) References Cited

U.S. PATENT DOCUMENTS

| | | | | |
|---|---|---|---|---|
| 2,582,654 | | 1/1952 | Saban . | |
| 4,223,499 | * | 9/1980 | Shrunk | 52/308 |
| 4,420,919 | * | 12/1983 | Weber | 52/204 |
| 4,982,530 | * | 1/1991 | Palmer | 49/504 |
| 5,072,547 | | 12/1991 | DiFazio . | |
| 5,544,457 | | 8/1996 | Labrecque . | |
| 5,768,837 | * | 6/1998 | Sjoholm | 52/204.62 |
| 5,941,033 | | 8/1999 | Adams . | |

* cited by examiner

*Primary Examiner*—Carl D. Friedman
*Assistant Examiner*—Steve Varner
(74) *Attorney, Agent, or Firm*—Frank H. Foster; Kremblas, Foster, Phillips & Poliick

(57) ABSTRACT

A window or door sash of the type having a sash frame for receiving a transparent sheet, which is retained in the sash frame by a plurality of removably mounted glazing beads. A plurality of overlying wooden or other decorative covering members are each attached only to a glazing bead and extend over both the glazing beads and the interiorly facing surfaces of the sash frame. This arrangement provides the aesthetic beauty of wood, the durability of vinyl, aluminum, fiberglass or composite window working components, no unsightly fasteners and the easy and convenient replacement of a broken glass without damage to the wood or other components and without requiring complete replacement of the entire sash.

11 Claims, 5 Drawing Sheets

WINDOW AND DOOR SASH WITH INTERIOR WOOD COVERING

BACKGROUND OF THE INVENTION

1. Field of the Invention

This invention relates generally to components for building construction and more particularly relates to a prefabricated window sash or door sash having structural components of durable, man-made materials and an aesthetically, attractive interior wood covering.

2. Description of the Related Art

Windows and doors are essential components of buildings intended for human habitation. Windows ordinarily have an outer, stationary window frame and a movable sash having an outer frame surrounding a transparent sheet, such as glass or plastic, which are collectively referred to as glass. These include double hung, casement, slider and awning windows, which are distinguished by their type of sash movement. Some doors, such as patio doors and entry doors which can slide or pivot on hinges, are essentially a large sash, sized and positioned to permit passage of a human. Some windows, such as picture windows are stationary. All these types of sashes are known in the prior art and the invention is applicable to all of them. However, for convenience and brevity, the invention is described and illustrated in terms of windows, particularly a double hung window.

Windows and doors, including their sashes, have been constructed of a variety of materials, but the most common, traditional material is wood. However, modern technology has provided durable, man-made materials which can conveniently and inexpensively be extruded into window and door components, particularly framing components for forming a sash. These materials include vinyl, aluminum, fiberglass and composites of these and other materials. Sash frames formed of these materials offer the advantages of durability and stability because they are not subject to rotting or splitting and cannot soak up water and expand. The same materials have also been used to cover the exterior of a wooden sash and as a wrap enveloping wooden window components.

However, because wooden components are traditional and because the esthetic appearance of wood has come to be more highly regarded and appreciated than a half century or more ago, there is a demand for windows and doors which provide a wooden appearance. As a consequence, workers in the prior art have designed structures in which wooden coverings are attached on the interior side of durable, man-made sash framing members in order to simultaneously offer the advantages of the durable material together with the improved appearance and prestige of a wooden sash.

Although the attachment of a wooden covering to the outer window frame of a window may be accomplished in a relatively conventional manner, such as by the use of adhesives or screws, there have been significant problems and disadvantages with those prior art structures which provide a wooden covering on window sashes. While wooden covering members may be easily and conveniently bonded by a suitable adhesive to the sash frame of a window, a major problem is created if the transparent sheet mounted in the sash frame becomes broken and needs to be replaced.

By using adhesives for attaching a wood covering to a sash frame, a window sash is constructed in a way that makes it impossible to replace the glass, or other transparent sheet, without damaging or destroying the wood and perhaps the entire sash frame. The consequence is that a broken window requires complete replacement with a new sash. This can be particularly troublesome if the window was manufactured several years previously and is discontinued, or if the manufacturer is unknown to the owner of the building. The only remaining option becomes replacement of the entire window.

To overcome this problem, some workers in the prior art utilize fasteners and/or complicated interfitting parts to permit replacement of the glass. However, such prior art structures suffer from the disadvantage that unsightly fasteners are visible and therefore detract from the esthetic value of the window, or they require extensive manual manipulation, including for example the removal and reinstallation of screws, to accomplish disassembly, replacement of the glass and reassembly of the sash.

It is therefore an object and feature of the present invention to provide a window having the durability of durable, man-made materials and the prestigious appearance of wood, while having window sashes which are reglazable so that the glass can be replaced without damage or destruction of any component of the window.

Another object and feature of the present invention is to provide a sash with the above characteristics which has glass which is easily and conveniently removable and replaceable with a minimum of effort and manual manipulation and without the need to remove any fasteners.

Still another object and feature of the present invention is to provide a sash of the above type which has no unsightly fasteners, nail or screw holes visible from the building interior to detract from the wood finish.

Still another object and feature of the present invention is to provide a sash from which the wood covering layer may be easily removed for repair or replacement with a minimum of manual effort and yet when the entire sash is assembled in its operable position, the wood covering is locked in place.

BRIEF SUMMARY OF THE INVENTION

The invention is an improved sash having glazing beads, which are removably mounted to the sash frame for retaining a transparent sheet in the frame. The sash has a plurality of overlying covering members. Each covering member is attached only to a glazing bead. The covering members extend over both the glazing beads and the interiorly facing surfaces of the sash frame.

Figure 1:
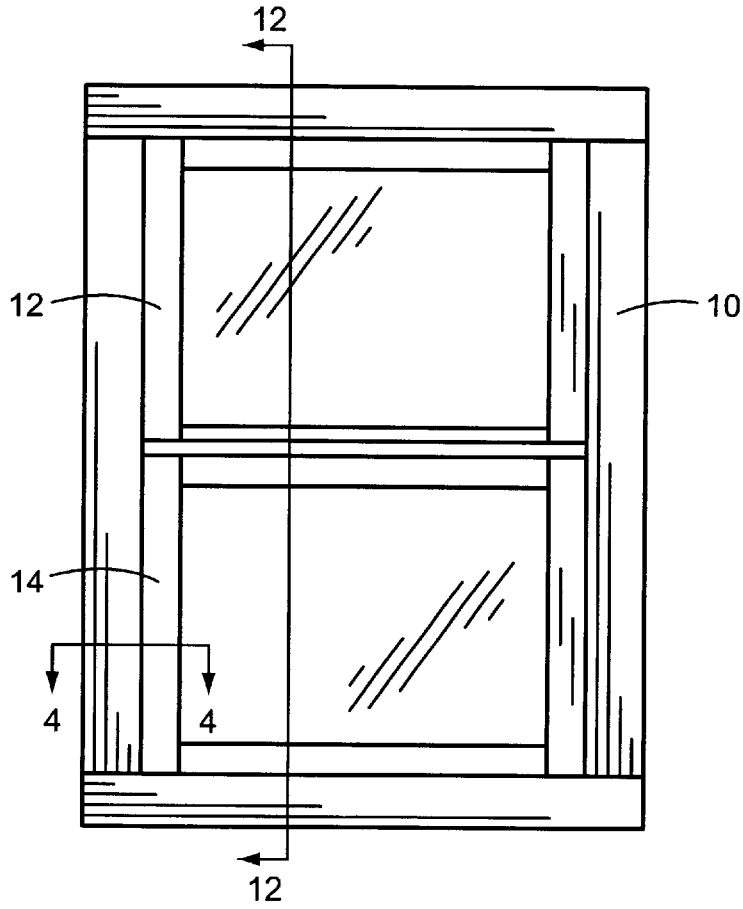
FIG. 1 is a view in front elevation of an embodiment of the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

FIG. 1 illustrates a window of conventional appearance, but embodying the present invention. The window of FIG. 1 has an outer window frame 10, an upper sash 12 and lower sash 14, each of which are vertically slidable in the frame 10 in the conventional manner.

Figure 2:
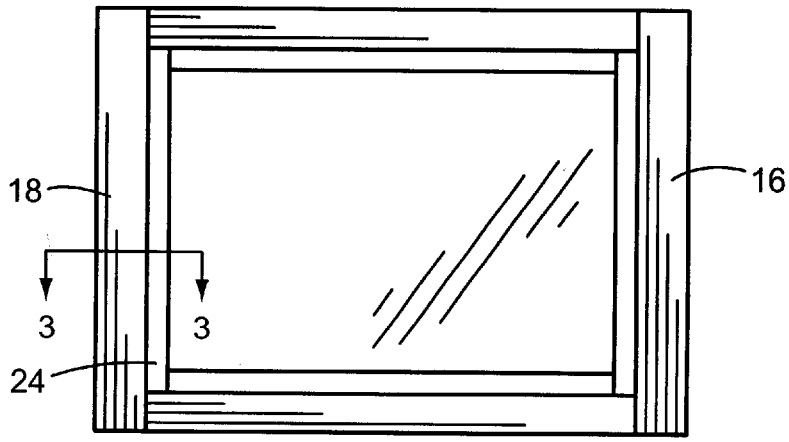
Fig. 2 (Prior Art)
FIG. 2 is a view in front elevation of a window sash constructed in accordance with the prior art but having components similar to some components of the present invention.
Figure 3:
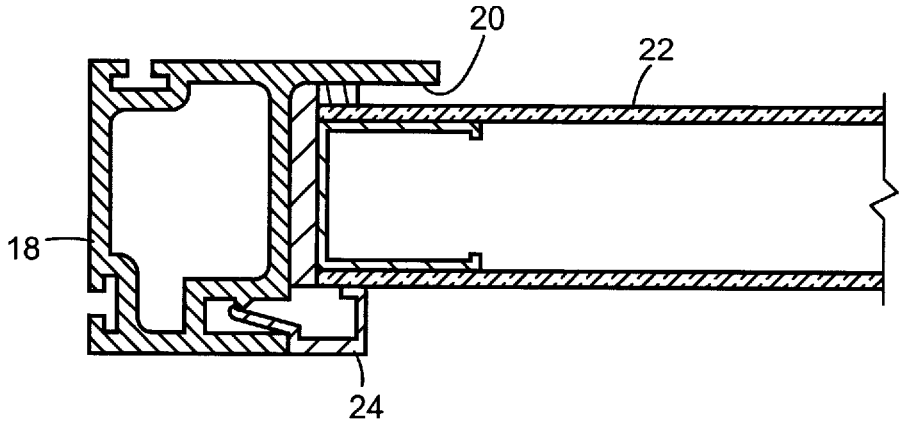
Fig. 3 (Prior Art)
FIG. 3 is a view in horizontal section taken substantially along the line 3—3 of FIG. 2.

Referring to FIGS. 2 and 3, a vinyl or aluminum window sash of the prior art consists of a plurality of extrusions joined at their ends to form a rectangular window sash frame 16. Each extrusion forms a frame member, such as frame member 18, on one side of the rectangular sash and has a flange forming an inwardly (i.e. toward the center of the window) extending shoulder 20. The shoulder 20 receives a sheet of glass or other transparent material 22, and retains the transparent sheet in the sash frame. The transparent sheet 22 illustrated in the figures consists of conventional double paned glass.

The sash frame 16 also has a plurality of inwardly extending glazing beads, such as glazing bead 24, which are spaced from the shoulder 20 and are removably mounted to the sash frame 16. The glazing beads, such as glazing bead 24, retain the transparent sheet 22 in the frame between the glazing bead and the shoulder 20.

Figure 4:
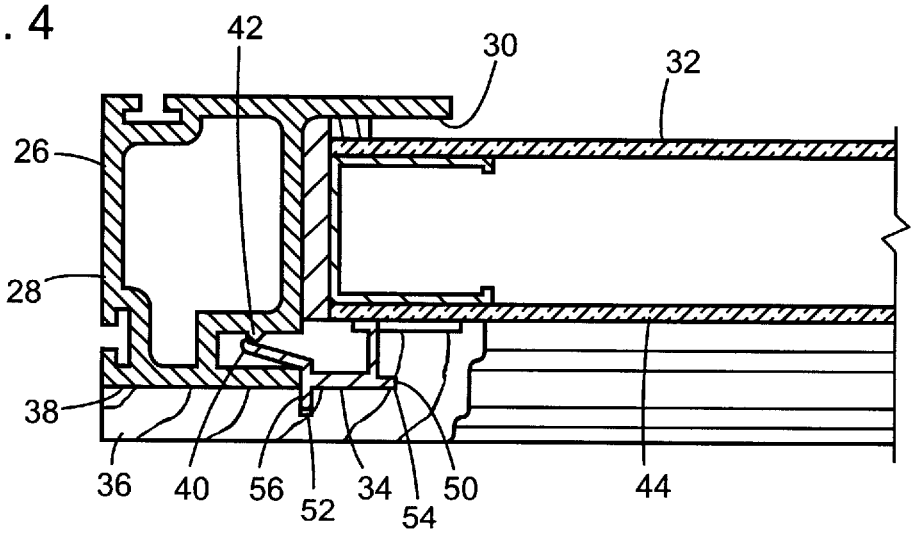
FIG. 4 is a view in horizontal section similar to FIG. 3, but illustrating the preferred embodiment of the invention and taken substantially along the line 4—4 of FIG. 1.
Figure 5:
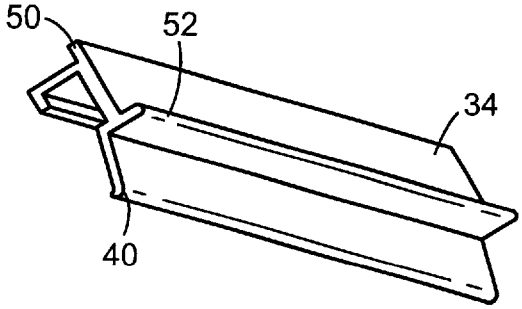
FIG. 5 is a front plan view of a glazing bead embodying features of the present invention.
Figure 6:
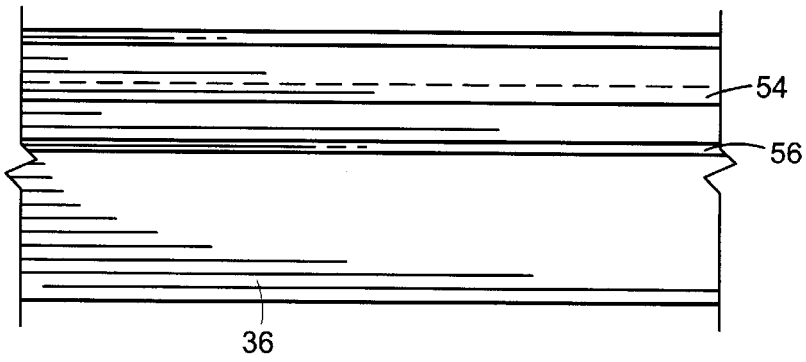
FIG. 6 is a bottom view of a segment of a covering member, which is used in a preferred embodiment of the invention.

Referring now to FIGS. 4–6, the sash 26 embodying the invention has a sash frame member 28, shoulder 30, transparent, double paned glass sheet 32 and glazing bead 34, all formed similarly to the structure illustrated in FIGS. 2 and 3. However, the sash of FIGS. 4–6 is additionally provided with a plurality of overlying covering members, such as wooden covering member 36. These covering members are attached only to the glazing bead 34 and extend over both the glazing bead 34 and the interiorly facing surfaces, such as interiorly facing surface 38 of the sash frame 16. Preferably each wood covering member extends inwardly beyond the glazing bead into contact with the transparent sheet 32.

The glazing bead 34 and the frame member 28 are formed with releasable, mutually engaging latch members, which are oriented for engagement by sliding the glazing beads outwardly along the surface of the transparent sheet 32 into engagement with the frame 28. The glazing bead 34 is disengaged from the frame 28 by sliding the glazing bead 34 inwardly in the opposite direction. More specifically, the preferred latch members, illustrated in the figures, comprise a flexible pawl 40, preferably and most conveniently formed as a portion of the glazing bead 34 and a cooperating strike 42 formed on the window frame member 28.

With this preferred structure the transparent sheet 32 is placed in the window frame and seated against the shoulder 30. Then each of the glazing beads, such as glazing bead 34, together with its attached wooden covering member 36 is, in turn, simply placed against the interior surface 44 of the transparent sheet 32 inwardly of the frame member 28 and then slid outwardly (e.g. to the left of FIG. 4) until the end of the pawl 40 rides up the inclined ramp formed on the strike 42 and finally passes the end of the ramp and moves upwardly in FIG. 4. The pawl 40 thereby engages the strike and releasably retains both the glazing bead 34 and its covering layer on the sash frame.

Removal is accomplished by the opposite manipulation. The wooden covering member 36 is simply pushed inwardly to deflect the pawl 40 causing it to ride up over the strike 42 and be released. The glazing bead 34 together with its covering member 36 are then moved inwardly until clear of the frame member 28 and then removed from the window.

There are a variety of ways of attaching a covering member 36 to each of the glazing beads, such as glazing bead 34, which can be used with the present invention without any attachment to the rest of the sash. For example, the covering members may be adhesively bonded or attached by suitable fasteners, such as screws, staples or nails, which are inserted first through the glazing bead and then into the wood so that the heads will not be visible upon assembly.

The preferred manner of attaching the covering member 36 to the glazing bead 34 is to form at least one and preferably two ridges 50 and 52, extending from the glazing bead 34. The covering member 36 is formed with mating slots 54 and 56, which are positioned and oriented for receiving the ridges 50 and 52. This interlocking of the ridges and slots retains the covering members in attachment to the glazing beads. Furthermore, this manner of attachment allows the wooden covering 36 to be easily removed from the glazing bead 34 after the glazing bead and covering assembly have been removed from the window.

Attachment of the wooden covering 36 to the glazing bead 34 is accomplished by simply aligning the slots and ridges end to end and then sliding one of these in the longitudinal direction of the slots and ridges with respect to the other to slide the ridges into the slots. Preferably, the slots have a width which is slightly less than the width of the ridges to provide frictional engagement. Removal is accomplished by simple longitudinal sliding of the glazing bead 34 relative to the wooden covering 36 until the ridges are slid out of the slots.

Although the ridges and cooperating slots could extend in parallel directions from the glazing beads and thereby rely solely on frictional engagement to retain the wooden covering member 36 on the glazing bead 34, it is preferred that the ridges extend in nonparallel directions to prevent sufficient force from overcoming the frictional engagement and allow removal of the wooden covering member 36 from the glazing bead 34. Most preferably, the ridge 50 extends generally inwardly of the window sash frame in a direction generally parallel to the transparent sheet 32 and the ridge 52 extends into the interior of the room and generally transverse to the transparent sheet 32. Most preferably, the ridges are nearly orthogonal, as illustrated in FIG. 4.

FIGS. 7–10 illustrate the ease with which the sash 26 may be sufficiently disassembled to permit the removal and replacement of the transparent sheet 32 in the case of breakage.

Figure 7:
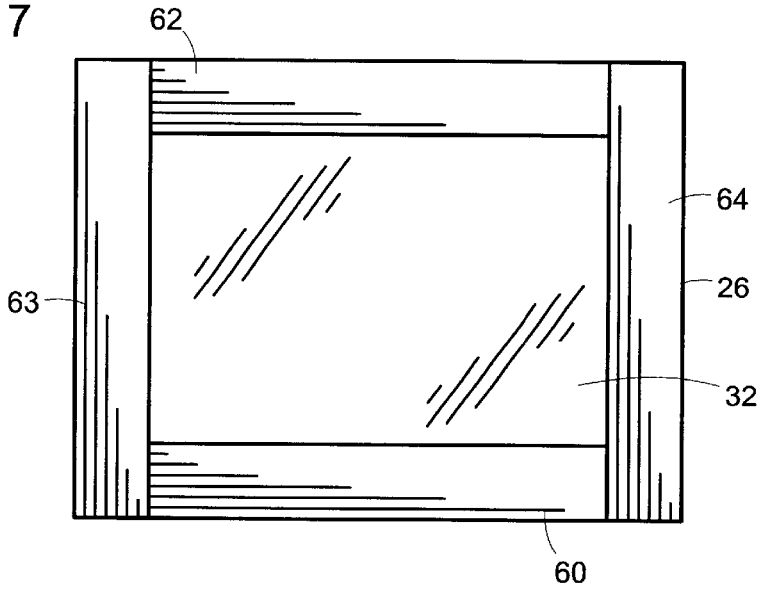
FIGS. 7–10 are views in front elevation of a window sash embodying the present invention and illustrating the removal of covering members with their attached glazing beads from their assembled positions on the sash.

FIG. 7 illustrates the sash 26 having a horizontal, lower rail covering member 60, a horizontal, upper rail covering member 62, a left, vertical stile covering member 63 and a right, vertical stile covering member 64. Each of these covering members is attached only to a glazing bead in the manner described above. The rail covering members 60 and 62 have their ends abutting the interior sides of the stile covering members 63 and 64. Consequently, it is necessary to remove the rail covering members in order that the stile covering members become free to slide and be removed, as described above. Of course, these relationships can be reversed so that the ends of the stile covering members abut the interior sides of the rail covering members, in which event the stile covering members must be removed first.

Figure 8:
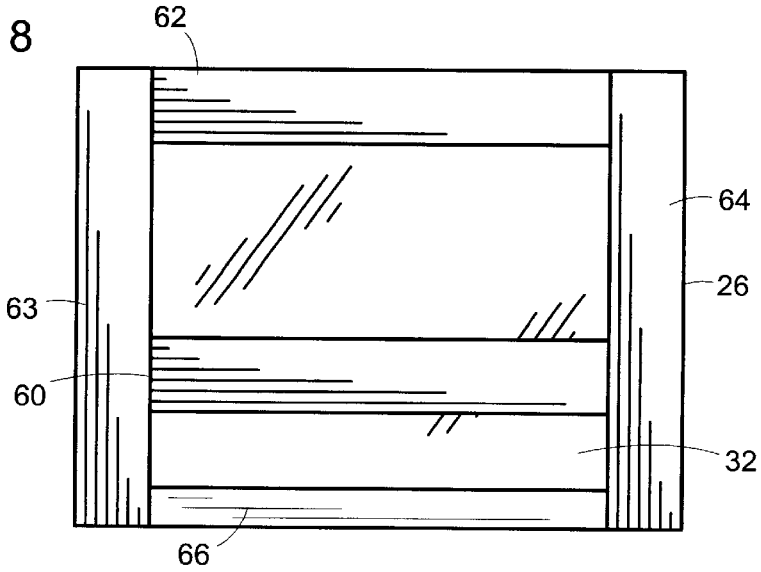

As shown in FIG. 8, the lower, rail covering member 60 may be slid upwardly along the transparent sheet 32 until its pawl 40 exits from within the frame member extrusion 66. It is then drawn perpendicularly away from the transparent sheet 32 for complete removal. Similarly, the rail covering member 62, together with its attached glazing bead, is slid downwardly along the transparent sheet 32 until it may be removed in the same manner.

Figure 9:
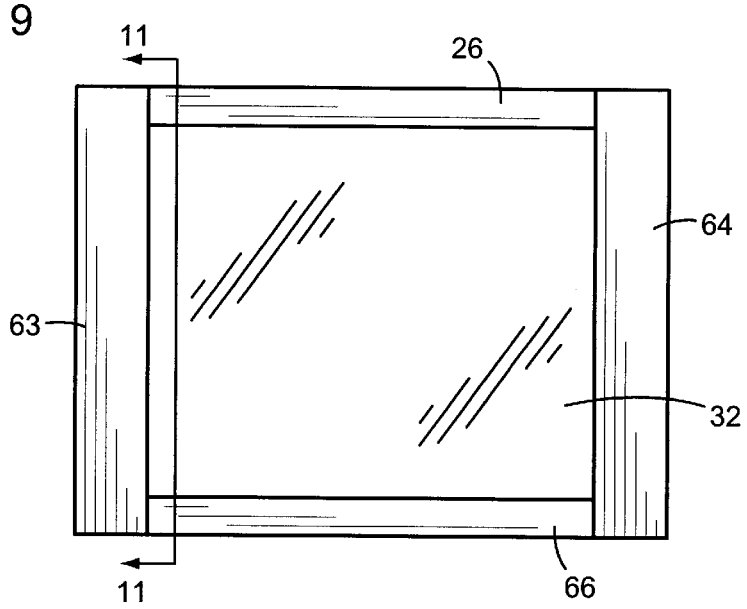

The stile covering members with their attached glazing beads then remain on the sash 26, as illustrated in FIG. 9. These are removed by similarly sliding the stile covering members 63 and 64 along the transparent sheet 32 until they too can be completely removed from the sash.

Figure 10:
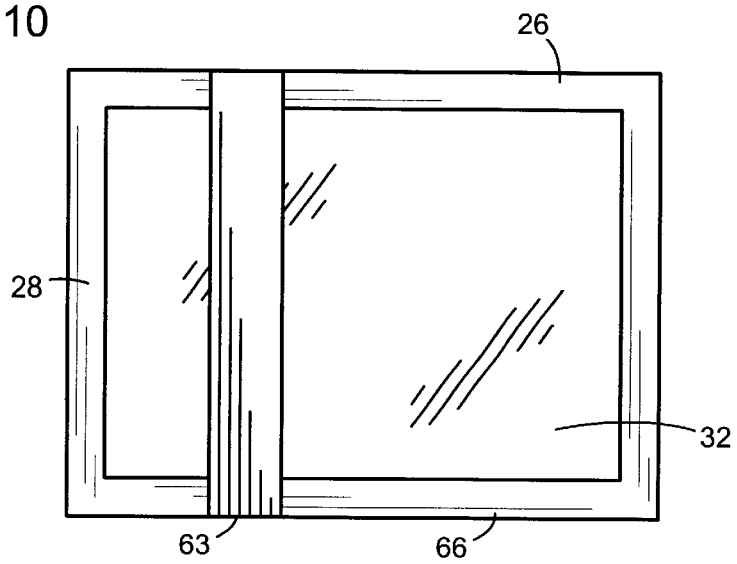

FIG. 10 illustrates the stile covering member 63 moved along the sheet to a position from which it can be removed from the sash. After removal of all four covering members and their attached glazing beads, the transparent sheet 32 is then removed from the sash and replaced. Then all four covering members and their attached glazing beads are replaced on the sash by reversing the manual manipulations described above.

Figure 11:
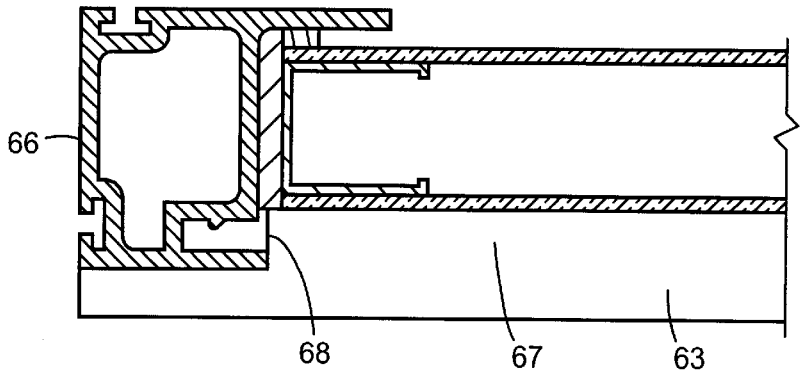
FIG. 11 is a view in vertical section taken substantially along the lines 11—11 of FIG. 9.

As illustrated in FIG. 4, the preferred covering member, such as 36, is L-shaped with the shorter leg of the L forming an ear which extends into contact with the transparent sheet to give a finished, completely wooden interior look. As illustrated in FIG. 11, on those covering members which must be installed first (e.g. the stiles 63 and 64 of FIG. 9), the ends of this ear 67 are routed or otherwise cut away to form a shoulder 68. This shoulder 68 abuts the inner edge of the frame member extrusions, such as extrusion 66, at each opposite end of the frame member extrusion, such as extrusion 63, to which the covering member is attached. This eliminates any possibility that these covering members can slide longitudinally along the glazing beads after they are installed.

Figure 12:
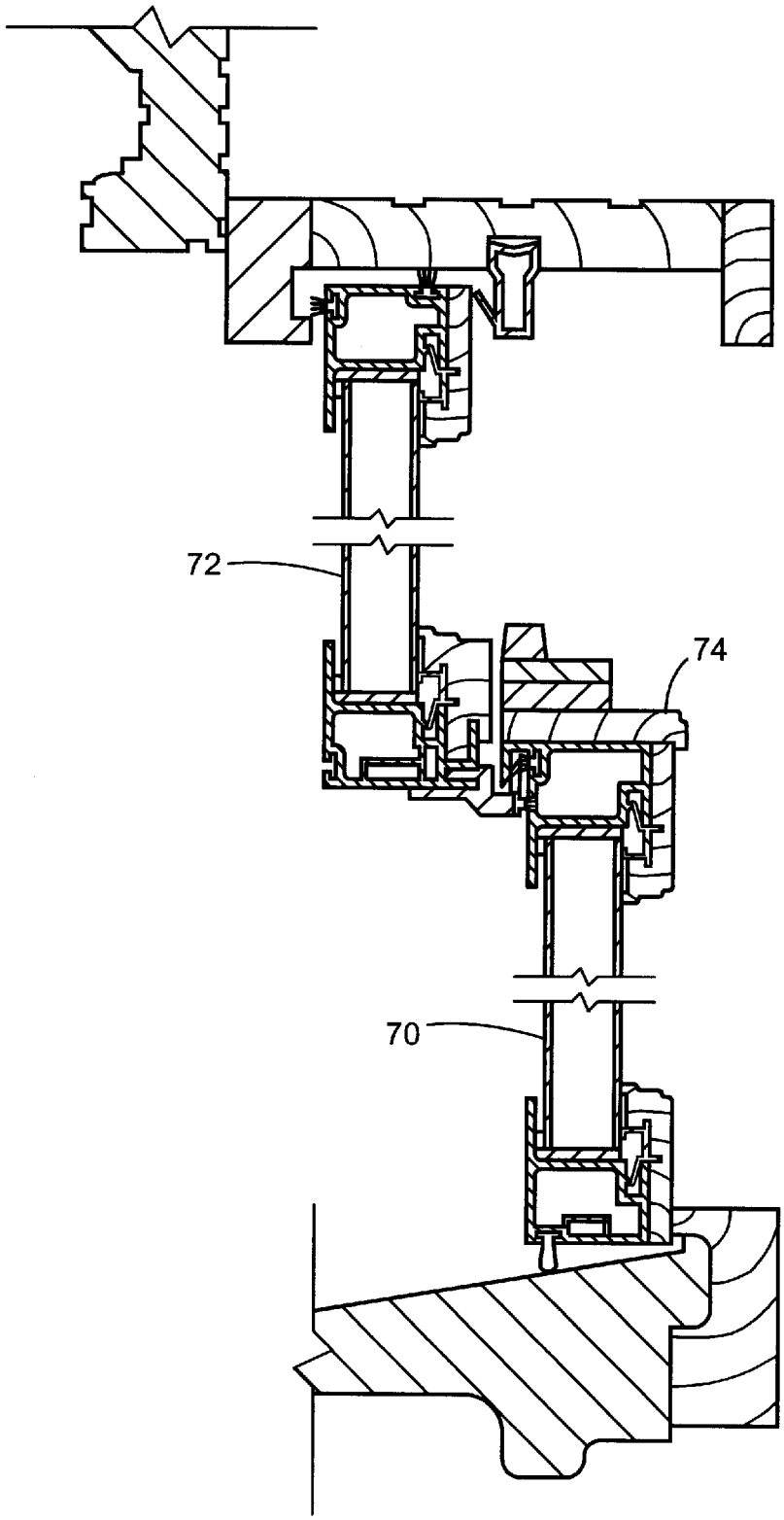
FIG. 12 is a view in vertical section taken substantially along the lines 12—12 of FIG. 1.

FIG. 12 is a view in vertical section of the embodiment of FIG. 1 and illustrates an entire window assembly embodying the present invention. Sashes 70 and 72 are conventionally positioned and slidable and have covering members in a form described above. In addition, a rail cap member 74 is also provided on the top of the lower sash 70. In this manner, it can be seen that the entire window appears to be a wooden window when viewed from the inside, which is from the left side in FIG. 12.

It should be apparent that some minor, insubstantial, supplemental attachment of the wooden covering member to the sash frame may be used without departing from the concept of the invention. Such supplemental attachment must necessarily be easily and rapidly removable and not be visible during operation of the door or window so that the covering member is still substantially only attached to the glazing bead in order to still obtain the advantages of the invention. For example, insubstantial small spots or a thin line of adhesive or an adhesive-like caulk or double sided tape can be interposed between the sash frame and the covering members so long as the bond can be severed easily and without damage, such as by running a razor blade or knife alone the edge of the sash between the sash frame and the covering member. Alternatively, an insubstantial number of small fasteners, such as staples or screws, could be used at the outer edges of some of the covering members, especially if their heads seated against the periphery of the sash frame.

While certain preferred embodiments of the present invention have been disclosed in detail, it is to be understood that various modifications may be adopted without departing from the spirit of the invention or scope of the following claims.

What is claimed is:

1. An improved sash, having a frame with an inwardly extending shoulder for receiving a transparent sheet and having a plurality of inwardly extending glazing beads spaced from the shoulder and removably mounted to the frame for retaining the transparent sheet in the frame between the glazing beads and the shoulder, wherein the improvement comprises:

a plurality of overlying covering members, each covering member attached substantially only to a removable glazing bead, the covering members extending over both the removable glazing beads and interiorly facing surfaces of the sash frame.

2. A sash in accordance with claim 1, wherein the covering members are wood.

3. A sash in accordance with claim 2 wherein the glazing beads and the frame are formed with releasable, mutually engaging latch members which are oriented for engagement by sliding the glazing beads outwardly along the transparent sheet into engagement with the frame and disengaged by sliding the glazing beads in the opposite direction.

4. A sash in accordance with claim 3, wherein the frame is rectangular, a first opposite pair of covering members are attached to a first opposite pair of glazing beads and are longer than the first pair of glazing beads and a second opposite pair of covering members are attached to a second opposite pair of glazing beads and have a length to extend between the first pair of covering members.

5. A sash in accordance with claim 4 wherein the latch members comprise a flexible pawl and a cooperating strike.

6. A sash in accordance with claim 1 or 2 or 3 or 4 or 5 wherein the covering members overlay substantially the entire interior surfaces of the frame and the glazing beads.

7. A sash in accordance with claim 1 or 2 or 3 or 4 or 5 wherein each glazing beads is formed with at least one interiorly extending ridge and the covering members are formed with mating slots positioned and oriented for receiving the ridges for retaining the covering members in attachment to the glazing beads.

8. A sash in accordance with claim 7 wherein ridges and the slots have respective widths for frictional engagement.

9. A sash in accordance with claim 8 wherein there are at least two, nonparallel ridges on the glazing beads and two mating slots on the covering members for sliding engagement by relative movement longitudinally of the ridges.

10. A sash in accordance with claim 9 wherein one of the ridges extends generally interiorly of the window sash frame and another ridge extends inwardly, generally parallel to the transparent sheet.

11. An improved sash, having a frame with an inwardly extending shoulder for receiving a transparent sheet and having a plurality of inwardly extending glazing beads spaced from the shoulder and removably mounted to the frame for retaining the transparent sheet in the frame between the glazing beads and the shoulder, wherein the improvement comprises:

at least two ridges extending in nonparallel orientations from the removable glazing bead for engaging mating slots on covering members for sliding engagement by relative movement longitudinally of the ridges wherein a first one of the ridges extends generally interiorly of the sash frame and another ridge extends generally orthogonally of the first ridge.

* * * * *